US005354639A

United States Patent [19]

Kasuya et al.

[11] Patent Number: 5,354,639

[45] Date of Patent: Oct. 11, 1994

[54] COLOR TONER FOR DEVELOPING ELECTROSTATIC IMAGE COMPRISING A POLYALKYLENE HAVING A CRYSTALLINITY OF 10-50%

[75] Inventors: Takashige Kasuya, Sohka; Takayuki Nagatsuka, Yokohama; Tatsuya Nakamura, Tokyo; Makoto Kanbayashi, Kawasaki; Tatsuhiko Chiba, Tokyo, all of Japan

[73] Assignee: Canon Kabushiki Kaisha, Tokyo, Japan

[21] Appl. No.: 936,503

[22] Filed: Aug. 28, 1992

[30] Foreign Application Priority Data

Aug. 29, 1991 [JP] Japan ..... 3-242398
Aug. 21, 1992 [JP] Japan ..... 4-222867

[51] Int. Cl.[5] ..... G03G 9/00

[52] U.S. Cl. ..... 430/109; 430/110; 430/124; 525/165; 525/241; 526/348.2; 526/348.3

[58] Field of Search ..... 430/109, 108, 110, 124; 525/165, 241; 526/348.2, 348.3

[56] References Cited

U.S. PATENT DOCUMENTS 4,952,477 8/1990 Fuller et al. ..... 430/109
4,990,424 2/1991 Van Dusen et al. ..... 430/106.6

FOREIGN PATENT DOCUMENTS 0421416 4/1991 European Pat. Off. .
3045983 9/1981 Fed. Rep. of Germany .
56-91244 7/1981 Japan .

OTHER PUBLICATIONS

Patent Abstracts of Japan, vol. 6, No. 112 (P-124) Jun. 23, 1982, for JPA 57-041,648, Published Mar. 8, 1982.

*Primary Examiner*—Steve Rosasco
*Attorney, Agent, or Firm*—Fitzpatrick, Cella, Harper & Scinto

[57] ABSTRACT

A color toner for developing electrostatic images is formed of color toner particles each including a binder resin, a polyalkylene, and a colorant. The color toner particles are formed by suspension polymerization. The polyalkylene is characterized by having a crystallinity of 10-50% and a melting enthalpy (as measured by a differential scanning calorimeter) of at most 35 cal/g. The color toner is characterized by an improved fixability without causing offset especially at a relatively low temperature and suitable for providing a transparency film for an overhead projection.

14 Claims, 1 Drawing Sheet

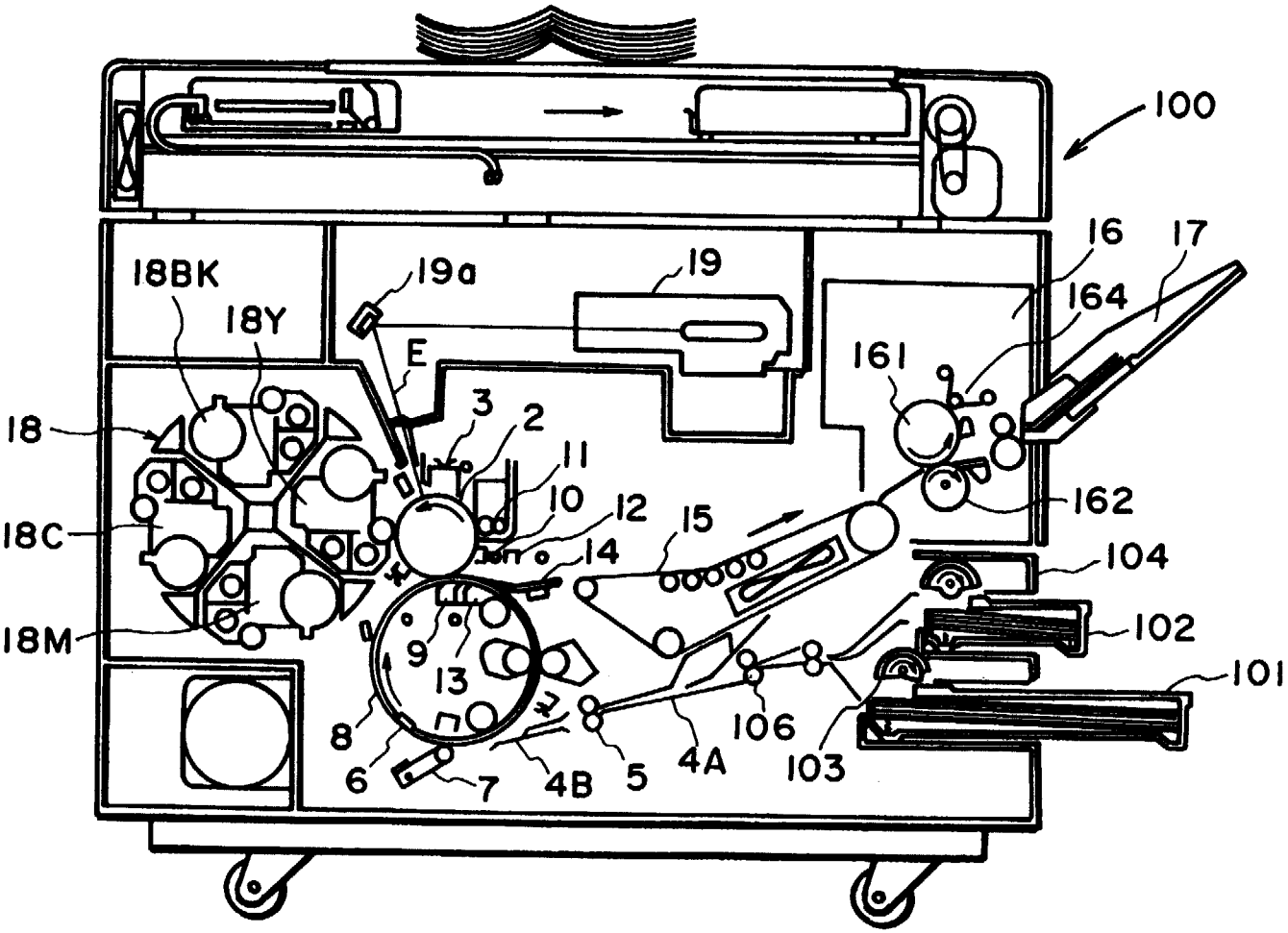
100
17
16
164
162
104
102
101
161
103
106
19
15
4A
5
12
14
11
10
2
4B
3
7
19a
E
13
9
8
6
18Y
18BK
18
18C
18M

COLOR TONER FOR DEVELOPING ELECTROSTATIC IMAGE COMPRISING A POLYALKYLENE HAVING A CRYSTALLINITY OF 10-50%

FIELD OF THE INVENTION AND RELATED ART

The present invention relates to a color toner for developing electrostatic images to form color images, particularly full-color images, by electrophotography. More specifically, the present invention relates to a color toner suitable for developing an electrostatic image by electrophotography to provide a transparency film which has a color image, particularly a full-color image, carried on a transparent film, and is to be set on an OHP (overhead projector) apparatus for projection on a screen.

Conventionally, a full-color image has been formed generally in the following manner. A photoconductive layer of a photosensitive drum as an electrostatic latent image holding member is uniformly charged by a primary charger and exposed imagewise to laser light modulated by a magenta image signal of an original to form an electrostatic latent image on the photosensitive drum, which is then developed with a magenta toner contained in a magenta developing unit to form a magenta toner image. The thus formed magenta toner image on the photosensitive drum is transferred by a transfer charger to a recording medium conveyed thereto.

On the other hand, the photosensitive drum after the transfer of the toner image to the recording medium is discharged (charge-removed) by a discharger, cleaned by a cleaning means and again charged by a primary charger, followed by similar formation of a cyan toner image and transfer of the cyan toner image to the recording member already carrying the above-mentioned magenta toner image. Then, similar operations are repeated for yellow and black colors so that toner image in totally four colors of magenta, cyan, yellow and black are transferred to the recording medium. Then, the recording medium having the four colors of toner images is supplied to fixing rollers where the toner images are fixed under the action of heat and pressure to form a fixed full-color toner image on the recording medium.

A toner used in a method of forming such a fixed color toner image is required to show excellent meltability on heating and color-mixing characteristic and is further preferred to show a low softening point and a low melt viscosity with a highly sharp-melting characteristic.

By using such a sharply melting toner, it is possible to obtain a color copy which shows excellent color reproducibility and is highly faithful to an original image.

However, such a sharply melting toner tends to have a high affinity with fixing rollers and is liable to cause offsetting onto a fixing roller.

Particularly, in the case of a fixing means for use in full-color toner image formation, a plurality of toner layers including those of magenta, cyan, yellow and black, such offsetting is particularly liable to be caused.

For the above reason, it has been conventionally practiced to apply a release agent, such as silicone oil, onto a fixing roller so as to enhance the toner releasability of the fixing roller. In this case, however, the following problems are accompanied.

When a release agent such as oil is applied onto a fixing roller, the entire apparatus becomes complicated, and the life of the fixing roller can be shortened by the oil application.

On the other hand, as one of various demands for copying in recent years, a resinous transparent film such as one for providing a transparency film for an overhead projector (OHP) has been widely used as a type of recording material. If a toner image is fixed onto such a transparent film by using a fixing method using such an oil as described above, the applied oil is attached to the surface of the transparent film to provide a sticky touch and remarkably deteriorates the quality of the transparency film carrying the resultant toner image.

Accordingly, there is an increasing demand for a fixing system without requiring such oil application at the time of fixing and a novel toner for realizing such a fixing system.

For the above-mentioned problems, there have been proposed a toner containing a release agent such as wax and a toner produced by suspension polymerization (Japanese Patent Publication (JP-B) 36-10231). In the suspension polymerization, a polymerizable monomer and a colorant (and also a polymerization initiator, a crosslinking agent, a charge control agent and other additives, as desired) are uniformly dissolved or dispersed to form a monomer composition, which is then dispersed in a dispersion medium (e.g., aqueous medium) containing a dispersion stabilizer by using an appropriate stirrer and simultaneously subjected to polymerization to form toner particles having a desired particle size.

In the suspension polymerization system, liquid droplets of the monomer composition are formed in a dispersion medium having a large polarity such as water, so that components having a polar group contained in the monomer composition tend to be present at the surfaces constituting an interface with the aqueous phase and non-polar components tend to be less present at the surface parts to form a so-called pseudo-capsule structure. By utilizing this process characteristic, it is possible to incorporate in a toner a low-melting point wax which cannot be used in another toner production process, such as the pulverization process.

Such a toner obtained by the polymerization process can satisfy both anti-blocking characteristic and low-temperature fixability which are generally contradictory with each other owing to the enclosure of a low-melting point wax. More specifically, the enclosed low-melting point wax does not lower the anti-blocking characteristic but promotes the internal thermal conductivity of the toner to realize low-temperature fixation. As a further preferable aspect, the wax melted at the time of fixation functions also as a release agent, so that undesirable high-temperature offset can be prevented without applying a release agent such as oil onto a fixing roller.

Thus, the polymerization toner enclosing wax shows advantageous performances at the time of fixation but has caused new problems when it is used in combination with a transparent film as the recording medium, such that the clarity or transparency of the resultant transparency film carrying the toner image after the fixation is somewhat lowered.

It may be conceived of decreasing the wax in order to prevent such a decrease in transparency of the fixed toner image, but this results in a lower releasability of the toner. Thus, the above difficulty has been inevitably encountered if wax is used in an amount to provide a sufficient release characteristic.

Further, in the case of forming a fixed toner image on a recording medium such as a resinous transparent film to provide a transparency film, it has been generally frequently practiced to use a lower fixing speed for sufficient toner melting than fixation on an ordinary recording material, such as paper, as it is strongly desired to form a toner image having a high optical transmittance. In this case, however, the toner on the recording medium is more liable to be offset to the fixing roller at the time of fixation, so that a larger amount of wax is required to be enclosed within the toner in order to show a sufficient releasability than in the case of fixation of a toner image on a recording medium such as paper.

Further, it has been confirmed that the use of a toner image by using such a toner enclosing wax rather results in a decrease in clarity of the resultant transparency film due to opacification caused by crystallization of the wax per se.

Further, in the case of forming a color or full-color toner image on a resinous transparent film by using an electrophotographic system of the dry development type and projecting the toner image onto a screen by means of an OHP apparatus, the projected image can show a grayish tint as a whole to result in a very narrow range of color reproduction even when the image on the film shows a sufficient color reproducibility. This phenomenon is caused because the yet-unfixed toner image on a smooth transparent film is not provided with a sufficient fluidity by the heating at the time of fixation to retain its particle characteristic and the light incident to the toner image at the time of the projection is scattered to form a shadow on the screen. Particularly, at a halftone part showing a low image density, the absorption level by the dye or pigment in the toner is lowered due to a decrease in number of toner particles and the resultant absorption level becomes identical to a black absorption level due to scattering by toner particles, so that the reproduced color tint becomes grayish.

In the case of naked eye observation of a toner image on a recording medium such as plain paper, a light image reflected from an illuminated fixed toner image is observed, so that the image quality is little affected even if the toner surface retains some particle characteristic. In the case of observing or projecting a toner image onto a screen by transmitted light as in an OHP apparatus, the image quality based on transmittance is remarkably impaired due to light scattering if the toner image retains some toner particle shape. Accordingly, the toner used for providing a transparency film is desired to show a better fixability to reduce the particle characteristic of the fixed toner image and show a good anti-offset characteristic at the time of fixation.

SUMMARY OF THE INVENTION

An object of the present invention is to provide a color toner for developing electrostatic images having solved the above-mentioned problems.

A more specific object of the present invention is to provide a color toner for developing electrostatic images showing a good anti-offset characteristic without oil application at the time of fixation and capable of forming a color or full-color image of excellent quality.

Another object of the present invention is to provide a color or full-color transparency film having an excellent light transmittance and capable of providing a clear projection image on a screen with light transmitted therethrough.

A further object of the present invention is to provide a color toner for developing electrostatic images showing an excellent low-temperature fixability.

According to the present invention, there is provided a color toner for developing electrostatic images, comprising: color toner particles each comprising a binder resin, a polyalkylene, and a colorant:

wherein the color toner particles have been obtained by suspension polymerization, and the polyalkylene has a crystallinity of 10–50% and a melting enthalpy (as measured by a differential scanning calorimeter) of at most 35 cal/g.

These and other objects, features and advantages of the present invention will become more apparent upon a consideration of the following description of the preferred embodiments of the present invention taken in conjunction with the accompanying drawings.

BRIEF DESCRIPTION OF THE DRAWING

The sole figure in the drawing is a schematic view of an electrophotographic apparatus in which the color toner of the invention is used to provide full-color images.

DETAILED DESCRIPTION OF THE INVENTION

A characteristic feature of the color toner for developing electrostatic images according to the present invention is that it contains a polyalkylene having a crystallinity of 10–50% and a melting enthalpy (as measured by a DSC (differential scanning calorimeter)) of at most 35 cal/g.

According to our study, it has been found that, if a polyalkylene having a crystallinity of 10–50%, preferably 20–35%, is incorporated in a color toner, the resultant color toner is provided with improved fixability and anti-offset characteristic without impairing the clarity of the resultant image when used to provide a transparency film.

If the crystallinity exceeds 50%, the resultant toner image constituting the transparency film (hereinafter referred to as "transparency film image") is caused to have a remarkably inferior clarity or transparency. On the other hand, if the crystallinity is below 10%, the preservability and flowability of the resultant toner become inferior.

The polyalkylene used in the present invention is further characterized by having a melting enthalpy $\Delta H$ of at most 35 cal/g, preferably at most 25 cal/g. If the melting enthalpy $\Delta H$ exceeds 35 cal/g, the low-temperature fixability of the resultant toner is adversely affected.

Another characteristic feature of the color toner of the present invention is that it comprises toner particles containing the polyalkylene which have been obtained through suspension polymerization.

We have succeeded in obtaining a toner having a pseudo-capsule structure including a core substance consisting mainly of the polyalkylene and a shell covering the core substance. As a result, it has become possible to obtain a color toner which is excellent in anti-blocking property, fluidity and developing characteristic, and also excellent in capability of providing a transparency film image having an excellent clarity, fixability and anti-offset characteristic. Herein, the core substance consisting mainly of the polyalkylene refers to a case wherein the polyalkylene occupies 50 wt. % or more of the core substance as measured at the vicinity of the central part of a toner particle.

In the color toner particles of present invention, the polyalkylene may preferably be contained in a proportion of 2-50 wt. parts, particularly 5-35 wt. parts, per 100 wt. parts of the toner binder resin.

If the polyalkylene content is below 2 wt. parts, the resultant toner is caused to have an inferior release characteristic and a lower anti-offset characteristic. If the polyalkylene content exceeds 50 wt. parts, the particle forming characteristic at the time of production becomes inferior and also the anti-blocking characteristic of the resultant toner becomes inferior.

The polyalkylene may preferably have a melting point of 30°-150° C., more preferably 50°-100° C. If the melting point is below 30° C., the anti-blocking characteristic and shape-retaining characteristic of the resultant toner becomes insufficient. If higher than 150° C., a sufficient release effect is not exhibited. The melting point herein refers to one measured as a temperature giving a maximum heat absorption peak on a DSC curve.

Further, the crystallinity of a polyalkylene may be measured by X-ray diffraction. A crystalline part of a polymer provides a sharp peak and an amorphous part of a polymer provides a very broad peak, respectively, in an X-ray diffraction pattern. Accordingly, the crystallinity of a polymer is measured as an areal proportion of a crystalline peak of a sample polymer.

More specifically, the crystallinity values herein are based on values measured in the following manner.

An X-ray diffraction apparatus ("Rota Flex RU300", mfd. by Rigaku Denki K.K. under the conditions of: anticathode: Cu-target, tube voltage output: 50 kV, tube current output: 250 mA, and measurement angle range: $2\theta = 5 - 35$ degrees.

The crystallinity Xc of a sample polyalkylene may be calculated from the equation:

$$Xc = [Sc/(Sc + Sa)] \times 100\%,$$

wherein Sc = diffraction peak area of a crystalline component, and Sa = diffraction peak area of an amorphous component, respectively after compensation of a temperature factor (i.e., thermal oscillation correction factor) as usual.

For example, in the case of polyethylene as a polyalkylene, the crystalline peaks appear at at Bragg angles ($2\theta$) of 21.4 degrees, 23.8 degrees and 30 degrees, and the total of these peak areas provide Sc. On the other hand, the amorphous portion provides a broad peak around a Bragg angle ($2\theta$) of 19.5 degrees, and the peak area provides Sa.

Herein, the term "polyalkylene" refers to a natural or synthetic polymer having a polyalkylene chain including a homopolymer, a block copolymer or a graft copolymer of an alkylene or olefin. Examples of the alkylene or olefin may include: linear or branched $\alpha$-olefins, such as ethylene, propylene, butene-1, pentene-1, hexene-1, heptene-1, octene-1, nonene-1, and decene 1; and corresponding olefins having unsaturations at different positions.

The comonomer to be copolymerized with an alkylene or olefin may for example be an $\alpha,\beta$-ethylenically unsaturated monomer, examples of which may include: styrene-type monomers, such as styrene, o-methylstyrene, m-methylstyrene, p-methylstyrene, p-methoxystyrene, and p-ethylstyrene; acrylates, such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate and phenyl acrylate; methacrylates, such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylonitrile, methacrylonitrile, and acryl amide. Among these, styrene-type monomers are particularly preferred. These comonomers may be used in a proportion of 20 wt. or more, preferably 30-60 wt. %, based on the weight of the alkylene monomer.

A particularly preferred class of the polyalkylene used in the present invention is a graft copolymer comprising a polyalkylene main chain grafted with polymerized units of a comonomer as described above. The graft degree, i.e. the proportion of the comonomer used for grafting may preferably be 20 wt. % or more, particularly 30-60 wt. %, based on the polyalkylene main chain.

The polyalkylene used in the present invention is controlled to have a crystallinity of 10-50%. A preferred method of the crystallinity control is to use a polyalkylene having a branched structure, particularly a graft copolymer obtained by graft copolymerization under heating, followed by rapid or gradual cooling for adjustment of the crystallinity.

The color toner for developing electrostatic images according to the present invention comprises color toner particles which may preferably have a weight-average particle size of 2-12 $\mu$m, more preferably 4-9 $\mu$m, particularly preferably 5-8 $\mu$m.

Such color toner particles may be produced through suspension polymerization, e.g., in the following manner.

Additives such as a release agent including the above-mentioned polyalkylene, a colorant, a polymerization initiator and a charge control agent are added in a polymerizable monomer, and the mixture is heated until the release agent is dissolved or melted and is subjected to uniform dissolution or dispersion by using a mixer such as a homogenizer or an ultrasonic disperser to form a monomer composition, which is then dispersed in an aqueous medium containing a dispersion stabilizer at a temperature nearly equal to that of the monomer composition by using a mixer, such as an ordinary stirrer. The stirring speed and time are preferably adjusted so as to provide the resultant monomer droplets with a prescribed toner size of generally 30 $\mu$m or smaller, and thereafter the stirring is continued at such an intensity as to retain the particle size and prevent the precipitation of the particles under the action of a dispersion stabilizer. The polymerization temperature is set to a temperature below the precipitation temperature of the release agent, and the polymerization is effected in the presence of a polymerization initiator. After the reaction, the produced toner particles are washed, recovered by filtration and dried. In the suspension polymerization, it is generally preferred to use 300-3000 wt. parts of water as a dispersion medium per 100 wt. parts of the monomer composition.

The binder resin constituting the color toner in the form of a polymerization toner according to the present invention may preferably comprise principally (i.e. 50 wt. % or more of) the polymer of the above-mentioned polymerizable monomer, preferably an α, β-ethylenically unsaturated monomer, and include at least one polymer or copolymer having a polar groups also included in the monomer composition at the time of the suspension polymerization.

Examples of the α, β-ethylenically unsaturated monomer usable for constituting the polymerization toner may include: styrene-type monomers, such as styrene, o-methylstyrene, m-methylstyrene, p-methylstyrene, p-methoxystyrene, and p-ethylstyrene; acrylates, such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate and phenyl acrylate; methacrylates, such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylonitrile, methacrylonitrile, and acryl amide.

These monomers may be used singly or in mixture of two or more species. Among the above monomers, styrene or a styrene derivative may preferably be used singly or in mixture with another monomer in view of developing characteristics and successive image forming characteristics of the resultant toner.

The dispersion medium for producing the polymerization toner may be formed by dispersing a stabilizer, such as polyvinyl alcohol, gelatin, methyl cellulose, methyl hydroxypropyl cellulose, ethyl cellulose, sodium salt of carboxymethyl cellulose, polyacrylic acid or its salt, starch, calcium phosphate, aluminum hydroxide, magnesium hydroxide, calcium metasilicate, barium sulfate or bentonite in an aqueous medium. The stabilizer may preferably be used in an amount of 0.2–20 wt. parts per 100 wt. parts of the polymerizable monomer.

In order to finely disperse such a stabilizer, 0,001–0.1 wt. part of a surfactant may be used. The surfactant functions to promote the action of the dispersion stabilizer, and examples thereof may include: sodium dodecylbenzenesulfonate, sodium tetradecyl sulfate, sodium pentadecyl sulfate, sodium octyl sulfate, sodium oleate, sodium laurate, potassium stearate, and calcium oleate.

As briefly mentioned above, it is further preferred to add a polymer or copolymer having a polar group in the monomer composition for polymerization. Further, it is preferred in the present invention that a monomer composition to which a polymer, copolymer or cyclic rubber having a polar group has been added is suspended for polymerization in an aqueous medium which contains a dispersant chargeable to a polarity reverse to that of the polar polymer, etc. More specifically, a cationic (or anionic) polymer, copolymer or cyclic rubber contained in the monomer composition exerts an electrostatic attraction force at the surfaces of droplets of the monomer composition under polymerization with an anionic (or cationic) dispersant of the reverse chargeability, so that the surfaces of the droplets are covered with the dispersant to prevent the coalescence of the droplets and stabilize the dispersion, and the added polar polymer, etc., are caused to gather at the surfaces of the droplets to form a kind of shell, thus providing toner particles of a pseudo-capsule structure. A toner satisfying both fixability and anti-blocking characteristic which are generally contradictory with each other can be obtained by forming a shell of a polar polymer (or copolymer or cyclic rubber) having a relatively high molecular weight so as to provide excellent anti-blocking and anti-offset characteristic and a core of a component having a relatively low molecular weight contributing to an improved fixability through the polymerization. Examples of the polar polymer or copolymer and the reversely chargeable dispersant may be enumerated below:

(1) Cationic polymers or copolymers, inclusive of: homopolymers of a nitrogen-containing monomer, such as dimethylaminoethyl methacrylate or diethylaminoethyl methacrylate, and copolymers of such a nitrogen-containing monomer with another monomer, such as styrene or an unsaturated carboxylic acid ester.

(2) Anionic polymers or copolymers, inclusive of: homopolymers of a nitrile monomer such as acrylonitrile, a halogen-containing monomer such as vinyl chloride, an unsaturated carboxylic acid such as acrylic acid or methacrylic acid, an unsaturated dibasic acid, an unsaturated dibasic acid anhydride, and a nitro group-containing monomer, and also copolymers of these monomers with a styrene-type monomer.

Cyclic rubber can be used instead of the above-mentioned polar polymer or copolymer.

(3) Anionic dispersants including silica fine powder, particularly colloidal silica having a BET specific surface area of 200 $m^2/g$ or larger.

(4) Cationic dispersants including hydrophilic positively chargeable silica fine powder, such as aminoalkyl-modified colloidal silica, preferably having a BET specific surface area of 200 $m^2/g$ or larger, aluminum hydroxide, and calcium phosphate.

The polar polymer may preferably be added in an amount of 0.1–10 wt. parts, particularly 2–7 wt. parts, per 100 wt. parts of the polymerizable monomer.

The dispersant may preferably be used in a proportion of 0.2–20 wt. parts, particularly 0.3–15 wt. parts, per 100 wt. parts of the polymerizable monomer composition.

In the present invention, it is preferred to incorporate a charge control agent in the toner to control the chargeability of the toner. The charge control agent may be those having little polymerization inhibiting characteristic and little transferability to an aqueous medium selected from known charge control agents. Examples of positive charge control agents may include: nigrosine dyes, triphenylmethane dyes, quaternary ammonium salts, amine compounds and polyamine compounds. Examples of negative charge control agents may include: metal-containing salicylic acid compounds, metal-containing monoazo dye compounds, styrene-acrylic acid copolymer, and styrene-methacrylic acid copolymer. In the present invention, it is preferred to use a colorless or only pale-colored charge control agent so as not to impair the color tone of the resultant color toner.

The colorant contained in the toner used in the present invention may be known ones. Examples thereof may include: carbon black; iron black; dyes, such as C.I. Direct Red I, C.I. Direct Red 4, C.I. Acid Red 1, C.I. Basic Red 1, C.I. Mordant Red 30, C.I. Solvent Red 49, C.I. Solvent Red 52, C.I. Direct Blue 1, C.I. Direct Blue 2, C.I. Acid Blue 9, C.I. Acid Blue 15, C.I. Pigment Blue 15, C.I. Basic Blue 3, C.I. Basic Blue 5, C.I. Mordant Blue 7, C.I. Direct Green 6, C.I. Basic Green 4, and C.I. Basic Green 6; and pigments, such as Lead Yellow, Cadmium Yellow, Mineral Fast Yellow, Navel Yellow, Naphthol Yellow S, Hansa Yellow G, Permanent Yellow NCG, Turtladine Lake, Molybdenum Orange, Permanent Orange GTR, Benzidine Orange G, Cadmium Red, C.I. Pigment Red 122, Permanent Red 4R, Watching Red Ca-salt, Brilliant Carmine 3B, Fast Violet B, Methyl Violet Lake, Ultramarine, Cobalt Blue, Alkali Blue Lake, Victoria Blue Lake, quinacridone, disazo-type yellow pigments, C.I. Pigment Yellow 17, Phthalocyanine Blue, Fast Sky Blue, Pigment Green B, Malachite Green Lake, and Final Yellow Green G. When the toner is produced by polymerization, it is necessary to pay attention to the polymerization prohibiting property and transferability to water of a colorant used. For this reason, it is preferred to apply to the colorant used a surface treatment, such as a hydrophobicity-imparting treatment with a substance free from polymerization-inhibiting characteristic.

Examples of the polymerization initiator may include: azo or diazo type polymerization initiators, such as 2,2'-azobis(2,4-dimethylvaleronitrile), 2,2'-azobisisobutyronitrile, 1,1'-azobis(cyclohexane-1-carbonitrile) and 2,2'-azobis-4-methoxy-2,4-dimethylvaleronitrile; and peroxide type polymerization initiators, such as benzoyl peroxide, methyl ethyl ketone peroxide, diisopropyl peroxycarbonate, cumene hydroperoxide, 2,4-dichlorobenzoyl peroxide, and lauroyl peroxide. It is also possible to use a redox type initiator comprising a peroxide as described above and a reducing agent, such as dimethylaniline, a mercaptan, a tertiary amine, an iron (II) salt or sodium sulfite.

The polymerization initiator may be appropriately used so as to provide a desired molecular weight, and the amount thereof in 0.1–10 wt. % of the polymerizable monomer may generally be sufficient.

The average particle size of a toner may be measured by using a Coulter counter (e.g., Coulter counter Model TA-II, available from Coulter Electronics Inc.) equipped with a 100 μm-aperture and using a sample dispersion containing 2–20 mg of a sample toner in 100–150 ml of a 1%-NaCl aqueous solution with 0.1–5 ml of an alkylbenzene sulfonic salt as a surfactant to measure a particle size dispersion in the range of 2–40 μm as a basis for calculation of an average particle size.

Now, a color image forming method using the color toner according to the present invention will be described.

The sole figure in the drawing is a schematic sectional view of an electrophotographic apparatus 100 capable of producing a full-color image according to the method of the present invention. Referring to the figure, the apparatus is roughly divided into a recording medium-conveying system (I) including a transfer drum 8 and shown in a right-to-middle part of the apparatus, a latent image-forming section (II) disposed at the middle of the apparatus adjacent to the transfer drum 8, and a rotary developing apparatus (III) as a developing means disposed adjacent to the latent image-forming section (II). The recording medium-conveying system (I) includes recording medium-supplying trays 101 and 102 disposed releasably in an opening provided on the right side of the apparatus body 100; recording medium-feed rollers 103 and 104 disposed almost immediately above the trays 101 and 102; recording medium-supply guides 4A and 4B disposed adjacent to the rollers 103 and 104 and equipped with supply rollers 106; the transfer drum 8 rotatably disposed adjacent to the recording medium supply roller 4B and having an abutting roller 7, a gripper 6, a recording medium-separation charger 12 and a separation claw 14 in this order from its upstream to downstream in the direction of its rotation indicated by an arrow along its outer periphery and also a transfer charger 9 and a recording medium-separation charger 13 inside thereof; a conveyer belt means 15 disposed adjacent to the separation claw 14; a discharge tray 17 disposed adjacent to the conveying end of the conveyer belt means 15 and extending outwardly from the apparatus body 100 so as to be releasable from the body 100; and a fixer 16 disposed adjacent to the tray 17.

The latent image-forming section (II) includes an electrostatic latent image-holding member (i.e., photoconductive drum) 2 disposed rotatably in the direction of an arrow so that its outer periphery contacts the outer surface of the transfer drum 8, and a charge-removing charger 10, a cleaning means 11, a primary charger 3, and an imagewise exposure means such as a laser beam scanner 19 including a polygonal mirror 19a for illuminating the outer surface of the photosensitive drum 2 to form an electrostatic latent image thereon, disposed in this order from the upstream to the downstream in the direction of the rotation in the vicinity of the photosensitive drum 2.

The rotary developing apparatus (III) includes a rotatably disposed housing (hereinafter called "rotating member") 18, and a yellow developing unit 18Y, a magenta developing unit 18M, a cyan developing unit 18C and a black developing unit 18BK respectively disposed within the rotating member 18 so as to visualize an electrostatic latent image formed on the outer periphery of the photosensitive drum 2 when placed at a position facing the outer surface of the photosensitive member 2.

A sequence of the operation of the image forming apparatus having an arrangement as described above will now be explained with respect to a full-color mode. When the photosensitive drum 2 is rotated in the arrow direction in the figure, the photoconductor on the drum 2 is uniformly charged by the primary charger 3 and then subjected to imagewise exposure with laser light E modulated by a yellow image signal based on an original (not shown) to form an electrophotographic latent image on the photosensitive drum 2, which is then developed by the yellow developing unit 18Y which has been placed at the developing position facing the photosensitive drum 2 by the rotation of the rotation member 18.

On the other hand, a recording medium (e.g., a various transparent film) conveyed through the supply guide 4A, supply roller 106 and supply guide 4B is held by the gripper 6 at a prescribed time and wound about the transfer drum 8 electrostatically by the abutting roller 7 and an electrode disposed opposite to the roller 7. The transfer drum 8 is rotated in the arrow direction synchronously with the photosensitive drum 2, and the developed image on the photosensitive drum 2 given by the yellow developing unit 18Y is transferred onto the recording medium at a place where the photosensitive drum 2 and the transfer drum 8 abut each other. The transfer drum 8 is further rotated so as to be ready for transfer of a subsequent color ("magenta" in the case shown in the figure).

The photosensitive drum is then charge-removed by the charge-removing charger 10, cleaned by the cleaning means 11, again charged by the primary charger 3 and then subjected to imagewise exposure based on a magenta image signal in the same manner as in the yellow exposure described above. During such electrostatic latent image formation on the photosensitive drum 2 based on the magenta image signal, the rotating member 18 is rotated so that the magenta developing unit 18M is disposed at the above-mentioned prescribed developing position. Then, a prescribed magenta developing operation is performed and the developed magenta image is transferred onto the recording medium already carrying the yellow image on the transfer drum 8 in the same manner as in the yellow development.

The above operation is repeated also with respect to a cyan color and a black color. After transfer of the four color images, a multi-color image is formed on the recording medium on the transfer drum 8, charge-removed with the respective chargers 12 and 3. Then, the recording medium carrying the multi-color image is released from the gripper 6, separated from the transfer drum 8 by the separation claw 14 and conveyed by the conveyer belt 15 to the fixer 16, where the multi-color image is fixed onto the recording medium under heat and pressure. In this way, one full-color print sequence is completed to provide a prescribed full-color print image.

The fixer 16 includes a hot fixing roller 161 and a pressing roller 162. The hot roller 161 may preferably be covered with a surface layer of, e.g., silicone rubber or fluorine-containing resin, having an excellent releasability. The pressing roller 162 may preferably be surfaced with a fluorine-containing resin.

As described above, according to the present invention, there is provided a color toner of excellent quality, which is fixable at a low temperature and shows a good anti-offset characteristic without oil application at the time of fixation. Further, the color toner according to the present invention can provide a color or full-color transparency film which shows a good light-transmission characteristic and provides a clear projection image on a screen with light transmitted therethrough.

Hereinbelow, the present invention is described more specifically based on Examples.

Example 1

451 wt. parts of 0.1 M-$Na_3PO_4$ aqueous solution was added to 7–9 wt. parts of deionized water, followed by warming at 60° C. and stirring by a TK homomixer (mfd. by Tokushu Kika Kogyo K.K.) at 12,000 rpm. Then, 67.7 wt. parts of 1.0 M-$CaCl_2$ aqueous solution was gradually added thereto to form a dispersion medium containing $Ca_3(PO_4)_2$.

Then, the following ingredients constituting a monomer composition were provided.

| | |
|---|---|
| Styrene | 170 wt. parts |
| 2-Ethylhexyl acrylate | 30 wt. parts |
| Polyalkylene** (Xc (crystallinity) = 30%, Tmp (melting point = 90° C., ΔH (melting enthalpy) = 22 cal/g) | 15 wt. parts |
| C.I. Pigment Blue 15 | 10 wt. parts |
| Styrene-methacrylic acid-methyl methacrylate copolymer | 5 wt. parts |
| Di-tert-butylsalicylic acid metal compound | 3 wt. parts |

(**The polyalkylene was prepared by graft-polymerizing styrene monomer onto polyethylene at a graft ratio of 50%, followed by rapid cooling.)

Of the above-listed ingredients, only C.I. Pigment Blue 15, di-tert-butyl salicylic acid metal compound and styrene were subjected to preliminary mixing by a mixer ("Ebara Milder", mfd. by Ebara Seisakusho K.K.). Then, the remaining ingredients were added, and the entire mixture was warmed at 80° C. and dissolved and dispersed with each other to form a monomer mixture. Then, while the mixture was held at 80° C., 10 parts of dimethyl 2,2'-azobisisobutyrate (initiator) was added thereto to form a monomer composition.

Into the above-prepared dispersion medium under stirring in a 2 liter-flask, the above monomer composition was added and dispersed into particles under stirring by the TK homomixer at 10000 rpm for 20 min. at 80° C. in a nitrogen atmosphere. Then, the content was stirred by a paddle stirrer for 13 hours of polymerization reaction at 80° C.

After the polymerization, the product was cooled, acidified with hydrochloric acid to dissolve $Ca_3(PO_4)_2$, recovered by filtration, washed with water and dried to obtain color toner particles.

The thus-obtained color toner particles were found to have a weight-average particle size of 8.2 μm and a sharp particle size distribution as measured by a Coulter counter. A particle section was observed by a transmission electron microscope by stained ultramicrotomy, whereby a capsule structure having a surface layer consisting mainly of the styrene-acrylic resin and a core consisting mainly of the polyalkylene was observed.

0.7 wt. part of hydrophobic silica having a BET specific surface area of 200 $m^2/g$ was externally added to 100 wt. parts of the color toner particles to obtain a color toner for developing electrostatic images. Further, 7 wt. parts of the toner was mixed with 93 wt. parts of a Cu-Zn-Fe type ferrite carrier surface-coated with styrene-methyl methacrylate copolymer to obtain a developer.

The developer was charged in a re-modeled commercially available full-color copying machine ("CLC-500", mfd. by Canon K.K.) and used to form an image on a PET (polyethylene terephthalate) film as a recording medium under developing conditions including environmental temperature of 23° C. and humidity of 65% RH and a developing contrast of 320 volts.

A yet-unfixed toner image on the PET film formed by development and transfer in the re-modeled copying machine ("CLC-500") was fixed by passing through an external fixing machine (having the same roller arrangement as the one in the "CLC-500" copying machine but having no oil applicator) at a fixing speed of 20 mm/sec.

As a result, a fixed toner image was formed without causing offset to provide a beautiful and clear transparency film. The transparency film was used for projection by an OHP apparatus to provide a very clear cyan-colored projected image. The color toner also showed an excellent low-temperature fixability.

Example 2

| | |
|---|---|
| Styrene | 160 wt. part(s) |
| Butyl acrylate | 40 wt. part(s) |
| Polyalkylene (Xc = 20%, Tmp = 80° C., ΔH = 22 cal/g) | 60 wt. part(s) |
| C.I. Pigment Yellow 17 | 10 wt. part(s) |
| Styrene-methacrylic acid copolymer | 5 wt. part(s) |
| Di-tert-butylsalicylic acid metal compound | 3 wt. part(s) |

A yellow toner was prepared in the same manner as in Example 1 except that the above ingredients were used instead of those listed in Example 1.

The yellow toner was used for image formation otherwise in the same manner as in Example 1 by using the same re-modelled copying machine to form a yet-unfixed toner image on a PET film, which was then fixed by passing through an external fixing machine comprising a fluorine-containing resin-type soft fixing roller and a silicon resin-type pressing roller without oil application.

As a result, a fixed toner image was formed without causing offset to provide a beautiful and clear transparency film. The transparency film was used for projection by an OHP apparatus to provide a very clear yellow-colored projected image. The toner also showed an excellent low-temperature fixability.

Example 3

| | |
|---|---|
| Styrene | 160 wt. part(s) |
| Butyl acrylate | 40 wt. part(s) |
| Polyalkylene (Xc = 30%, Tmp = 75° C., ΔH = 25 cal/g) | 10 wt. part(s) |
| C.I. Pigment Red 122 | 10 wt. part(s) |
| Styrene-methacrylic acid copolymer | 5 wt. part(s) |
| Di-tert-butylsalicylic acid metal compound | 3 wt. part(s) |

A magenta toner was prepared in the same manner as in Example 1 except that the above ingredients were used instead of those listed in Example 1.

The magenta toner was used for image formation otherwise in the same manner as in Example 1 by using the same re-modelled copying machine to form a yet-unfixed toner image on a PET film, which was then fixed by passing through the same external fixing machine used in Example 2.

As a result, a fixed toner image was formed without causing offset to provide a beautiful and clear transparency film. The transparency film was used for projection by an OHP apparatus to provide a very clear magenta-colored projected image. The toner also showed an excellent low-temperature fixability.

Comparative Example 1

| | |
|---|---|
| Styrene | 160 wt. part(s) |
| Butyl acrylate | 40 wt. part(s) |
| Polyalkylene (Xc = 60%, Tmp = 80° C., ΔH = 30 cal/g) | 10 wt. part(s) |
| C.I. Pigment Red | 10 wt. part(s) |
| Styrene-methacrylic acid copolymer | 5 wt. part(s) |
| Di-tert-butylsalicylic acid metal compound | 3 wt. part(s) |

A magenta toner was prepared in the same manner as in Example 3 except that the above ingredients including a polyalkylene having a crystallinity (Xc) of 60% instead of 30% were used instead of those listed in Example 3.

The magenta toner was used for image formation otherwise in the same manner as in Example 3 to form a yet-unfixed toner image on a PET film, which was then fixed in the same manner as in Example 3.

As a result, a fixed toner image was formed without causing offset while showing an excellent low-temperature fixing characteristic of the toner. However, when the resultant transparency film was used for projection by an OHP apparatus, the resultant projected image was grayish as a whole showing a remarkably inferior clarity of the transparency film.

Comparative Example 2

| | |
|---|---|
| Styrene | 160 wt. part(s) |
| Butyl acrylate | 40 wt. part(s) |
| Polyalkylene (Xc = 48%, Tmp = 80° C., ΔH = 40 cal/g) | 10 wt. part(s) |
| C.I. Pigment Red 122 | 10 wt. part(s) |
| Styrene-methacrylic acid copolymer | 5 wt. part(s) |
| Di-tert-butylsalicylic acid metal compound | 3 wt. part(s) |

A magenta toner was prepared in the same manner as in Example 3 except that the above ingredients including a polyalkylene having a crystallinity (Xc) of 48%, Tmp of 80° C. and a melting enthalpy (ΔH) of 40 cal/g were used instead of those listed in Example 3.

The magenta toner was used for image formation otherwise in the same manner as in Example 3 to form a yet-unfixed toner image on a PET film, which was then fixed in the same manner as in Example 3.

As a result, the toner showed an inferior fixability, particularly an inferior low-temperature fixability causing a low-temperature offset phenomenon.

Comparative Example 3

A magenta toner was prepared in the same manner as in Example 3 except that the polyalkylene was replaced by polypropylene ("550P", Sanyo Kasei K.K.) having a crystallinity (Xc) of 55%, a melting point (Tmc) of 147° C. and a melting enthalpy (ΔH) of 21.4 cal/g.

The magenta toner was used for image formation otherwise in the same manner as in Example 3 to form a yet-unfixed toner image on a PET film, which was then fixed in the same manner as in Example 3.

As a result, a fixed toner image was formed without causing offset. However, when the resultant transparency film was used for projection by an OHP apparatus, the resultant projected image was grayish as a whole showing a remarkably inferior clarity of the transparency film.

What is claimed is:

1. A color toner for developing electrostatic images, comprising:

color toner particles each comprising a binder resin, a polyalkylene, and a colorant;

wherein the color toner particles have been obtained by suspension polymerization of a polymerizable monomer composition including an $\alpha,\beta$- ethylenically unsaturated monomer, a polar polymer or copolymer, the polyalkylene and the colorant by dispersion within an aqueous medium and polymerized in the presence of a polymerization initiator;

wherein each color toner particle has a capsule-like structure comprising a core substance comprising the polyalkylene and an outer shell covering the core substance as confirmed by observation of a section thereof by stained microtomy through a transmission electron microscope; and wherein the polyalkylene has a crystallinity of 10–50% and a melting enthalpy (as measured by a differential scanning calorimeter) of at most 35 cal/g.

2. The color toner according to claim 1, wherein said polyalkylene has a crystallinity of 20–30%.

3. The color toner according to claim 1, wherein said polyalkylene has a melting enthalpy of at most 25 cal/g.

4. The color toner according to claim 1, wherein said polyalkylene has a melting point of 30°-150° C.

5. The color toner according to claim 1, wherein said polyalkylene has a melting point of 50°-100° C.

6. The color toner according to claim 1, wherein said polyalkylene is contained in a proportion of 2-50 wt. parts per 100 wt. parts of the binder resin.

7. The color toner according to claim 1, wherein said polyalkylene is contained in a proportion of 5-35 wt. parts per 100 wt. parts of the binder resin.

8. The color toner according to claim 1, wherein the core substance comprises 50 wt. % or more of the polyalkylene as measured at a central part of each toner particle.

9. The color toner according to claim 1, wherein said polyalkylene comprises a homopolymer or copolymer of a linear or branched olefin.

10. The color toner according to claim 1, wherein said polyalkylene comprises a graft copolymer obtained by graft-polymerizing a comonomer onto a Polyalkylene main chain, followed by heating and coating at a controlled rate.

11. The color toner according to claim 1, wherein said polyalkylene comprises a graft copolymer obtained by graft-polymerizing styrene monomer onto polyethylene, followed by quenching.

12. The color toner according to claim 1, wherein during the suspension polymerization, the polymerizable monomer composition is heated until the polalkylene is dissolved or melted to be uniformly dissolved or dispersed therein, and the monomer composition is dispersed within the aqueous medium to form droplets which are subjected to polymerization in the presence of the polymerization initiator.

13. The color toner according to claim 12, wherein said polymerizable monomer composition further includes a polar polymer in an amount of 0.1-10 wt. parts per 100 wt. parts of the polymerizable monomer.

14. The color toner according to claim 1, wherein said binder resin comprises principally a polymer of an ethylenically unsaturated monomer and further comprises a polar polymer.

* * * * *

UNITED STATES PATENT AND TRADEMARK OFFICE

CERTIFICATE OF CORRECTION

PATENT NO. : 5,354,639

DATED : October 11, 1994

INVENTOR(S) : TAKASHIGE KASUYA, ET AL.

It is certified that error appears in the above-identified patent and that said Letters Patent is hereby corrected as shown below:

ON TITLE PAGE

In [56] References Cited:

Under U.S. PATENT DOCUMENTS, insert:
--5,130,219 7/1992 Mori, et al.
5,135,833 8/1992 Matsunaga, et al.--.
Under FOREIGN PATENT DOCUMENTS, insert:
--36-10231 7/1961 Japan.--.

COLUMN 7

Line 40, "0,001-0.1" should read --0.001-0.1--.

COLUMN 15

Line 23, "Polyalkyl-" should read --polyalkyl- --.

Signed and Sealed this

Sixteenth Day of May, 1995

Bruce Lehman

*Attest:*

BRUCE LEHMAN

*Attesting Officer*

*Commissioner of Patents and Trademarks*